US012606404B2

(12) United States Patent
Isoda

(10) Patent No.: US 12,606,404 B2
(45) Date of Patent: Apr. 21, 2026

(54) TRANSPORT DEVICE THAT TRANSPORTS SHEET

(71) Applicant: KYOCERA Document Solutions Inc., Osaka (JP)

(72) Inventor: Ren Isoda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 57 days.

(21) Appl. No.: 18/642,937

(22) Filed: Apr. 23, 2024

(65) Prior Publication Data

US 2024/0359939 A1 Oct. 31, 2024

(30) Foreign Application Priority Data

Apr. 28, 2023 (JP) ..... 2023-074243

(51) Int. Cl.
*B65H 29/60* (2006.01)

(52) U.S. Cl.
CPC ..... *B65H 29/60* (2013.01); *B65H 2801/39* (2013.01)

(58) Field of Classification Search
CPC ..... B65H 2405/1117; B65H 2405/324
See application file for complete search history.

(56) References Cited

U.S. PATENT DOCUMENTS 8,038,143 B2 * 10/2011 Watanabe ..... H04N 1/00663 271/3.14
8,833,752 B2 * 9/2014 Tsutsui ..... B65H 1/04 271/127
10,301,139 B2 * 5/2019 Kaneko ..... B65H 31/20
10,464,771 B2 * 11/2019 Liao ..... B65H 43/00
2021/0101769 A1 4/2021 Kawasaki et al.

FOREIGN PATENT DOCUMENTS

JP 2021059398 A 4/2021

* cited by examiner

*Primary Examiner* — Howard J Sanders
(74) *Attorney, Agent, or Firm* — IP Business Solutions, LLC.

(57) ABSTRACT

A transport device includes a supply tray that supplies a sheet, a casing including a straight transport route through which the sheet is linearly transported, a reversing transport route through which the sheet is transported so as to be reversed, the reversing transport route being branched from the straight transport route, and an image reading device that reads an image on the sheet being transported through the straight transport route, and a straight path discharge tray including a first tray section pivotably attached to the casing, and a second tray section pivotably attached to the first tray section. The straight path discharge tray is switchable between an open state in which the first tray section and the second tray section form a receiving surface for the sheet, and a closed state in which the first tray section and the second tray section partially cover the casing.

6 Claims, 10 Drawing Sheets

TRANSPORT DEVICE THAT TRANSPORTS SHEET

INCORPORATION BY REFERENCE

This application claims priority to Japanese Patent Application No. 2023-074243 filed on Apr. 28, 2023, the entire contents of which are incorporated by reference herein.

BACKGROUND

The present disclosure relates to a transport device.

Transport devices configured to discharge a sheet through a straight path are known. To discharge the sheet through the straight path, the transport device includes a straight transport route.

SUMMARY

The disclosure proposes further improvement of the foregoing techniques.

In an aspect, the disclosure provides a transport device including a supply tray, a casing, and a straight path discharge tray. The supply tray supplies a sheet. Into the casing, the sheet is supplied from the supply tray. To the straight path discharge tray, the sheet is discharged from the supply tray and the casing, through a straight path. The casing includes a straight transport route through which the sheet is linearly transported, a reversing transport route through which the sheet is transported so as to be reversed, the reversing transport route being branched from the straight transport route, and an image reading device that reads an image on the sheet being transported through the straight transport route. The straight path discharge tray includes a first tray section pivotably attached to the casing, and a second tray section pivotably attached to the first tray section. The straight path discharge tray is switchable between an open state in which the first tray section and the second tray section form a receiving surface for the sheet, and a closed state in which the first tray section and the second tray section partially cover the casing.

DETAILED DESCRIPTION

Figure 1:
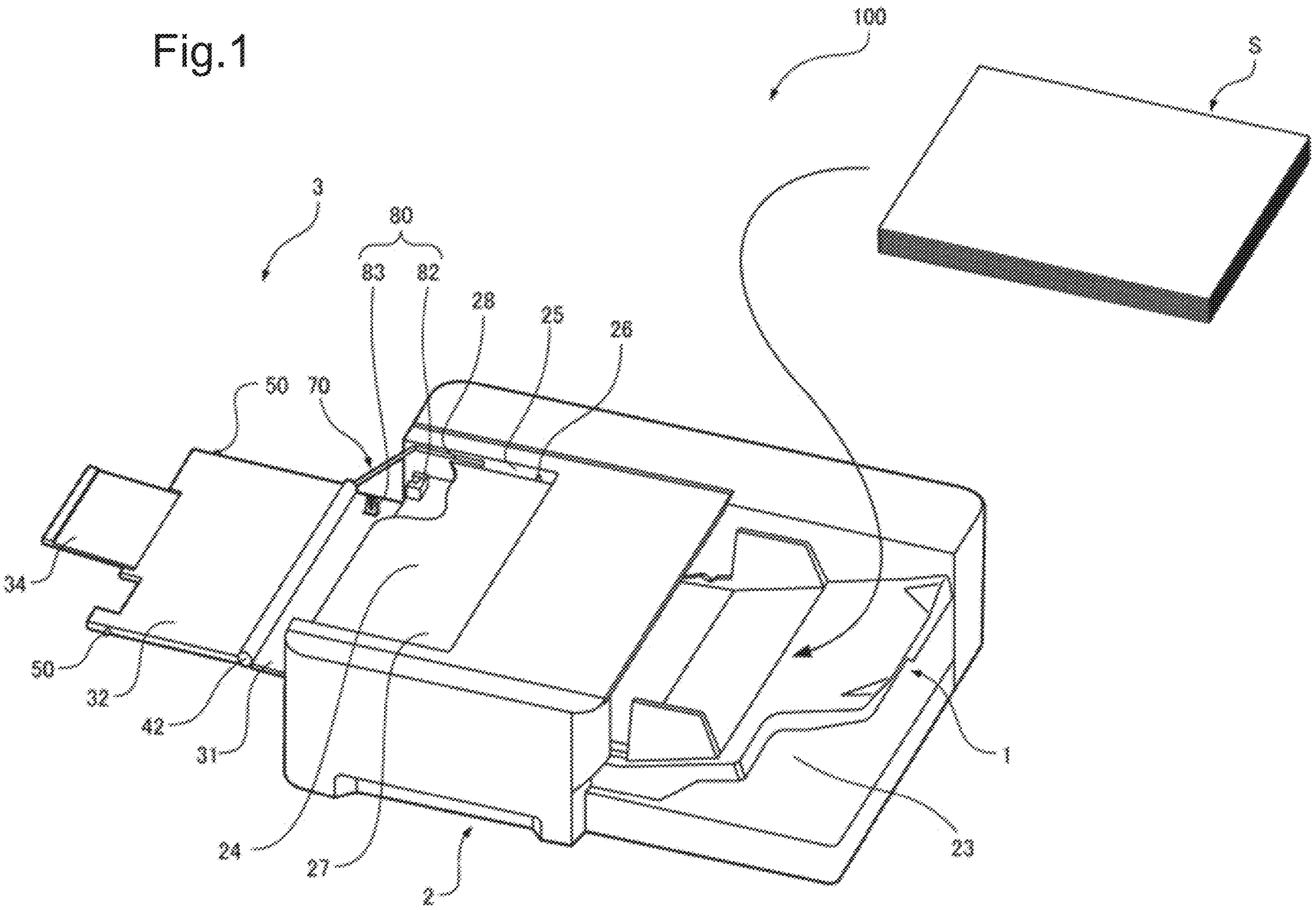
FIG. 1 is a perspective view showing a transport device according to an embodiment of the disclosure, in an open state.

Hereafter, a transport device according to an embodiment of the disclosure will be described, with reference to the drawings. In the drawings, the same or corresponding elements are given the same numeral, and the description of such elements will not be repeated. In the following description, some terms indicating specific positions or directions may be used. However, such terms are used simply for the sake of convenience in understanding the content of the embodiment, and not necessarily corresponding to the actual positions or directions.

Embodiment

Figure 2:
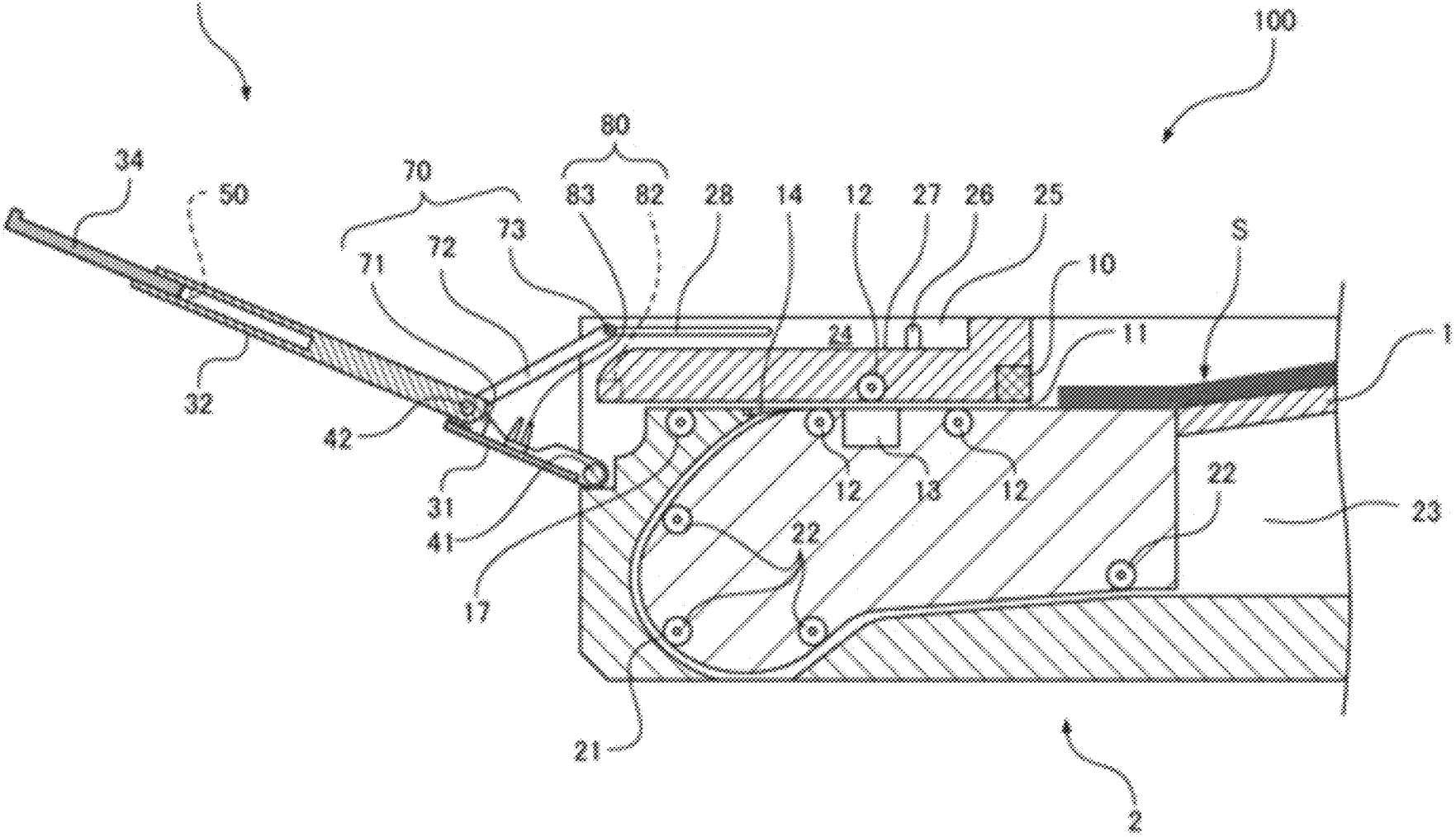
FIG. 2 is a vertical cross-sectional view showing the transport device in the open state.
Figure 3:
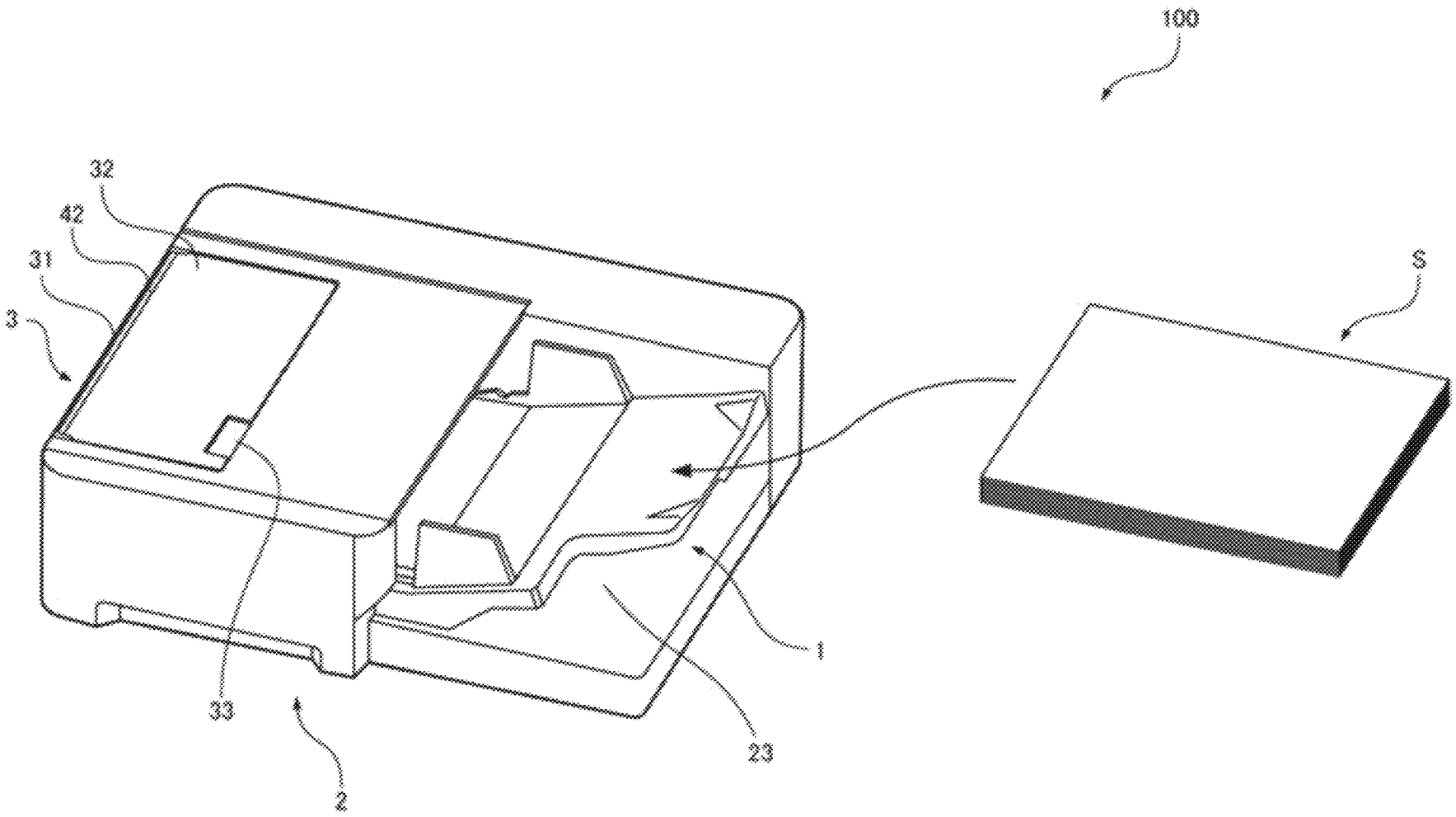
FIG. 3 is a perspective view showing the transport device, in a closed state.
Figure 4:
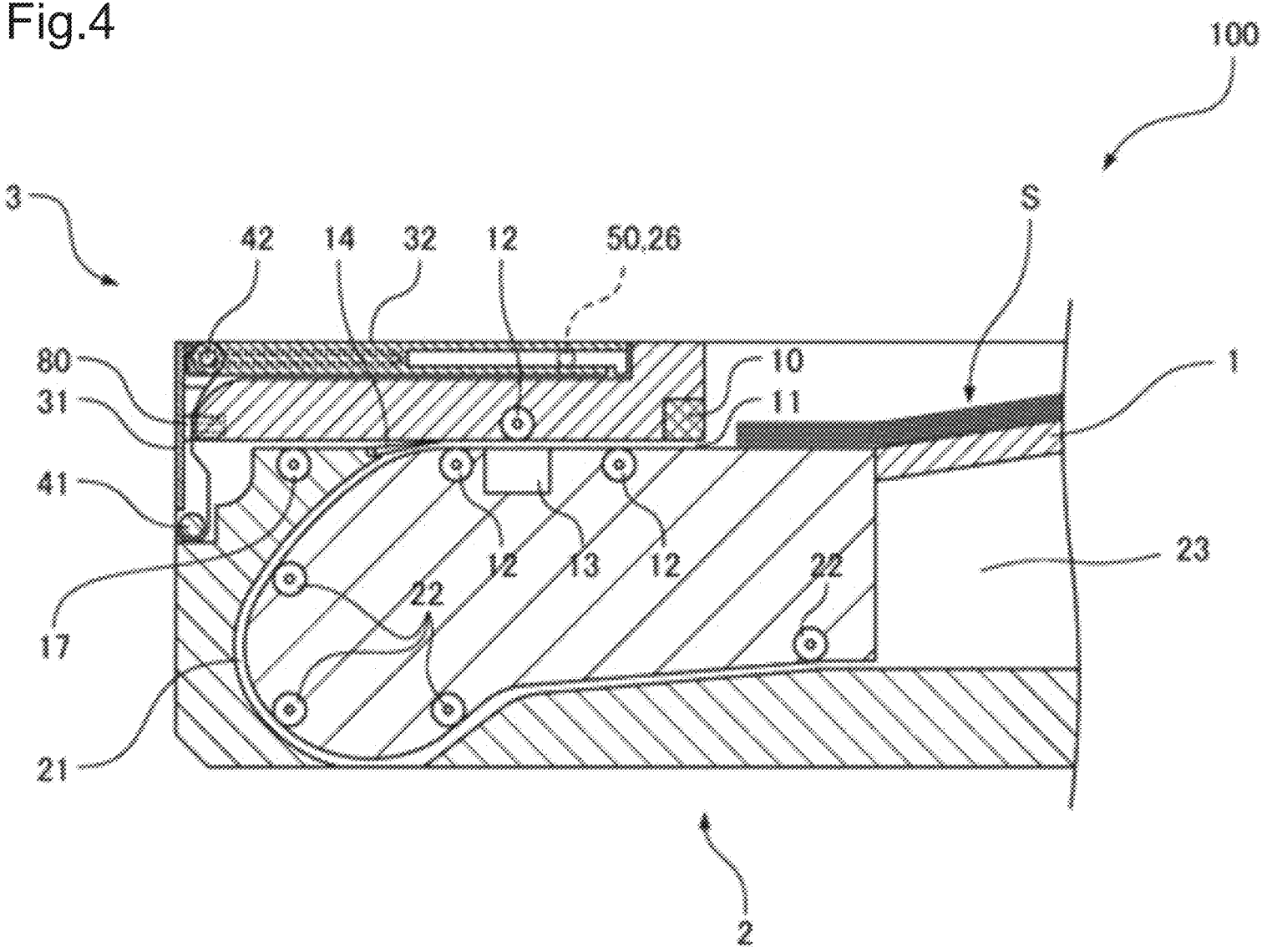
FIG. 4 is a vertical cross-sectional view showing the transport device in the closed state.

Referring to FIG. 1 to FIG. 4, the transport device 100 according to the embodiment will be described. FIG. 1 is a perspective view showing the transport device 100 according to the embodiment, in an open state. FIG. 2 is a vertical cross-sectional view showing the transport device 100 in the open state. FIG. 3 is a perspective view showing the transport device in a closed state. FIG. 4 is a vertical cross-sectional view showing the transport device in the closed state.

As shown in FIG. 1, the transport device 100 includes a supply tray 1, a casing 2, and a straight path discharge tray 3. The supply tray 1 supplies a sheet S. Into the casing 2, the sheet S is supplied from the supply tray 1. To the straight path discharge tray 3, the sheet S is discharged from the supply tray 1 and the casing 2, through a straight path.

As shown in FIG. 2, the casing 2 includes a straight transport route 11, a reversing transport route 21, and an image reading device 13. The straight transport route 11 is for linearly transporting the sheet S. The reversing transport route 21 is branched from the straight transport route 11. The reversing transport route 21 is for transporting the sheet S so as to be reversed. The image reading device 13 reads an image on the sheet S being transported through the straight transport route 11.

The straight path discharge tray 3 includes a first tray section 31 and a second tray section 32. The first tray section 31 is attached to the casing 2, so as to pivot with respect thereto. The second tray section 32 is attached to the first tray section 31, so as to pivot with respect thereto.

The straight path discharge tray 3 may further include an extension tray 34. This embodiment represents the case where the straight path discharge tray 3 includes the extension tray 34. The extension tray 34 is provided in the second tray section 32, on the opposite side of the first tray section 31. The extension tray 34 can be drawn out of and into the inside of the second tray section 32. The extension tray 34 can be drawn out from the second tray section 32, by a desired length.

The straight path discharge tray 3 can be switched between the open state and the closed state. FIG. 2 illustrates the open state, in which the first tray section 31 and the second tray section 32 form a receiving surface for the sheet S. In the closed state, as shown in FIG. 3 and FIG. 4, the first tray section 31 and the second tray section 32 partially cover the casing 2.

Therefore, the sheet S can be discharged through the straight path, in the open state. When it is not necessary to discharge the sheet S through the straight path, the straight path discharge tray 3 may be set to the closed state, so that the straight path discharge tray 3 is kept from occupying a large space. Therefore, while the transport device 100 is configured to discharge the sheet S through the straight path, the transport device 100 can save the installation space, when the sheet S is not scheduled to be discharged.

The receiving surface for the sheet S, formed of the first tray section 31 and the second tray section 32 is, preferably, a flat surface. However, the receiving surface for the sheet S may be a curved surface, without limitation to the flat surface, provided that the first tray section 31 and the second tray section 32 can receive the sheet S.

Referring to FIG. 2, the configuration of the transport device 100 will be described in detail. In the following description, the terms "upstream side" and "downstream side" respectively refer to the upstream side and the downstream side in the transport direction of the sheet S.

As shown in FIG. 2, the casing 2 further includes a sheet pickup device 10, a straight path transport roller group 12, a branch guide 14, a discharge roller 17, a reversing path transport roller group 22, and a discharge area 23.

The sheet pickup device 10 is located at an end portion of the straight transport route 11 on the upstream side. The sheet pickup device 10 picks up the sheet S one by one from the sheaf of the sheets S placed on the supply tray 1, and delivers the sheet S to the downstream side.

The straight path transport roller group 12 is provided along the straight transport route 11. Each of the rollers of the straight path transport roller group 12 serves to transport the sheet S along the straight transport route 11, by rotating.

The branch guide 14 is provided at the branch point between the straight transport route 11 and the reversing transport route 21. The branch guide 14 guides the sheet S located on the straight transport route 11 on the upstream side of the branch point, either to the downstream portion of the straight transport route 11, or to the reversing transport route 21.

The discharge roller 17 is provided on the straight transport route 11, at a position downstream of the branch guide 14. The discharge roller 17 serves to transport the sheet S to the straight path discharge tray 3, by rotating.

The reversing path transport roller group 22 is provided along the reversing transport route 21. Each of the rollers of the reversing path transport roller group 22 serves to transport the sheet S along the reversing transport route 21, by rotating.

The discharge area 23 is located under the supply tray 1. The discharge area 23 is for receiving the sheet S transported along the reversing transport route 21.

The straight transport route 11 is adjacent to the upstream end of the straight path discharge tray 3. Accordingly, the sheet S transported from the upstream side of the straight transport route 11 to the downstream side thereof is discharged to the straight path discharge tray 3, through the straight path.

A part of the lower end portion of the reversing transport route 21 is exposed from the casing 2. The partially exposed lower end portion of the reversing transport route 21 is opposed to a contact glass of a non-illustrated another image reading device. Accordingly, the sheet S transported through the reversing transport route 21 is read by the other image reading device, when passing the partially exposed lower end portion of the reversing transport route 21.

The sheet S is also read by the image reading device 13 in the casing 2, not only by the other image reading device. The image reading device 13 is located on the straight transport route 11, at a position upstream of the branch guide 14. Therefore, the sheet S is read by the image reading device 13, when transported only through the straight transport route 11, in other words when the sheet S is not read by the other image reading device.

Figure 5:
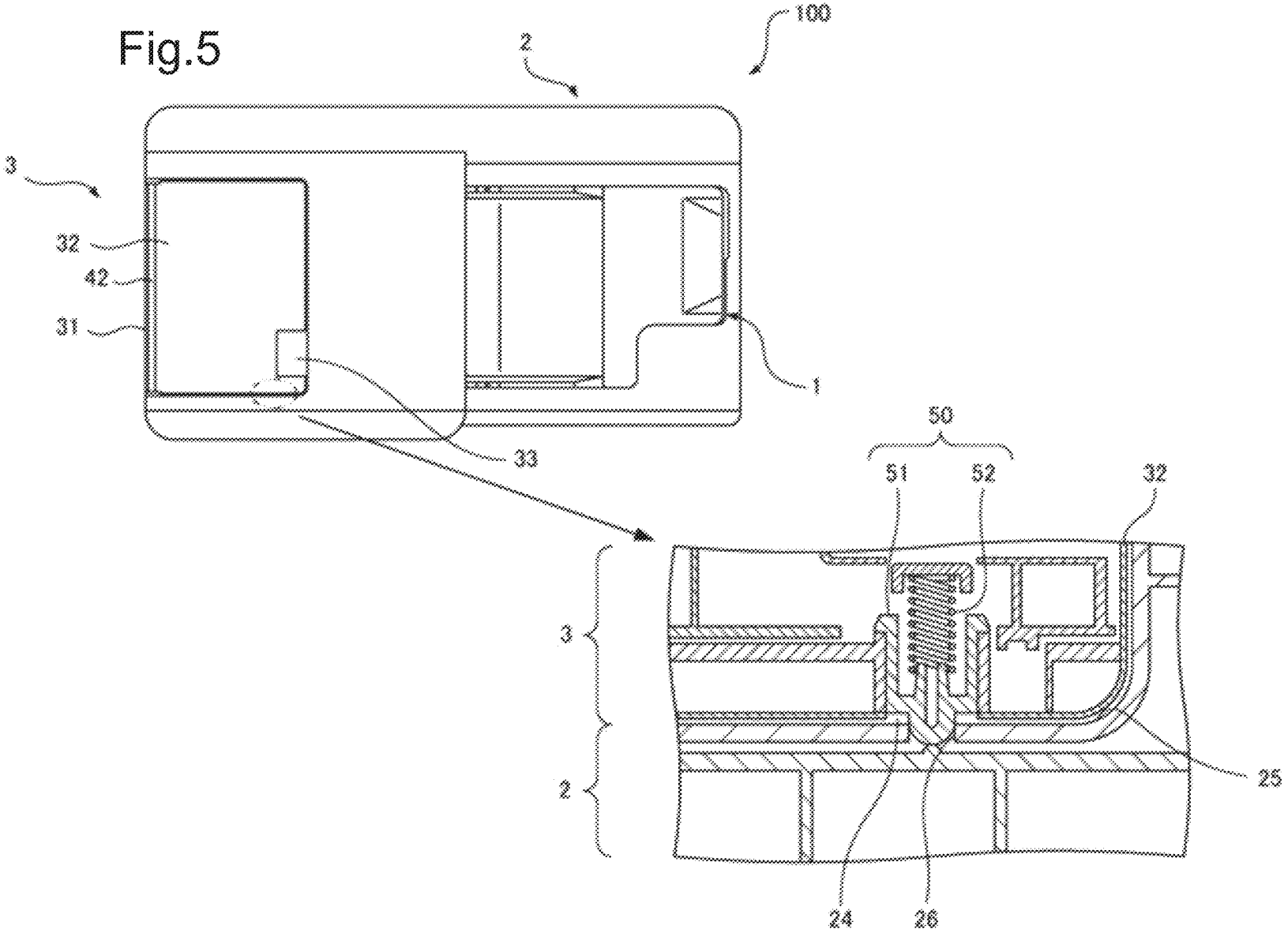
FIG. 5 includes a plan view and an enlarged cross-sectional view, for explaining how a straight path discharge tray is engaged with a casing.

Hereunder, a structure for engaging the straight path discharge tray 3 with the casing 2 will be described in detail, with reference to FIG. 5. FIG. 5 includes a plan view and an enlarged cross-sectional view, for explaining how the straight path discharge tray 3 is engaged with the casing 2.

As shown in FIG. 5, the straight path discharge tray 3 further includes an engagement device 50. With the engagement device 50, the straight path discharge tray 3 is engaged with the casing 2, in the closed state.

Accordingly, the engagement device 50 serves to stabilize the closed state of the straight path discharge tray 3. When the straight path discharge tray 3 is not used to discharge the sheet, straight path setting the discharge tray 3 to the closed state leads to reduction in space occupied with the transport device 100.

The casing 2 includes a storage space 24 and an engaging hole 26. In the storage space 24, the second tray section 32 is accommodated, in the closed state. The engaging hole 26 is formed in the side face of the casing 2 opposing the storage space 24 (inner side face 25 to be subsequently described).

The engagement device 50 is provided on the second tray section 32. The engagement device 50 includes a protrusion 51 and a coil spring 52. The protrusion 51 is opposed to the engaging hole 26, when the second tray section 32 is accommodated in the storage space 24. The coil spring 52 presses the protrusion 51 in the direction away from the second tray section 32. When the second tray section 32 is made to pivot from above the casing 2 so as to be accommodated in the storage space 24 (set to the closed state), the protrusion 51 of the second tray section 32 is pressed by the coil spring 52 toward the engaging hole 26 formed in the side face, at the position corresponding to the engaging hole 26. Accordingly, after the protrusion 51 enters the engaging hole 26, the protrusion 51 is retained inside the engaging hole 26, by the pressure of the coil spring 52. Thus, the engagement device 50 is engaged with the casing 2.

The straight path discharge tray 3 includes a handle 33, attached to the second tray section 32. The user can smoothly set the straight path discharge tray 3 from the open state to the closed state, by holding the handle 33 and making the straight path discharge tray 3 to pivot from the posture of the open state to the posture of the closed state. Since the straight path discharge tray 3 can thus be smoothly shifted from the open state to the closed state, the space saving effect of the transport device 100 can be smoothly attained.

Figure 6:
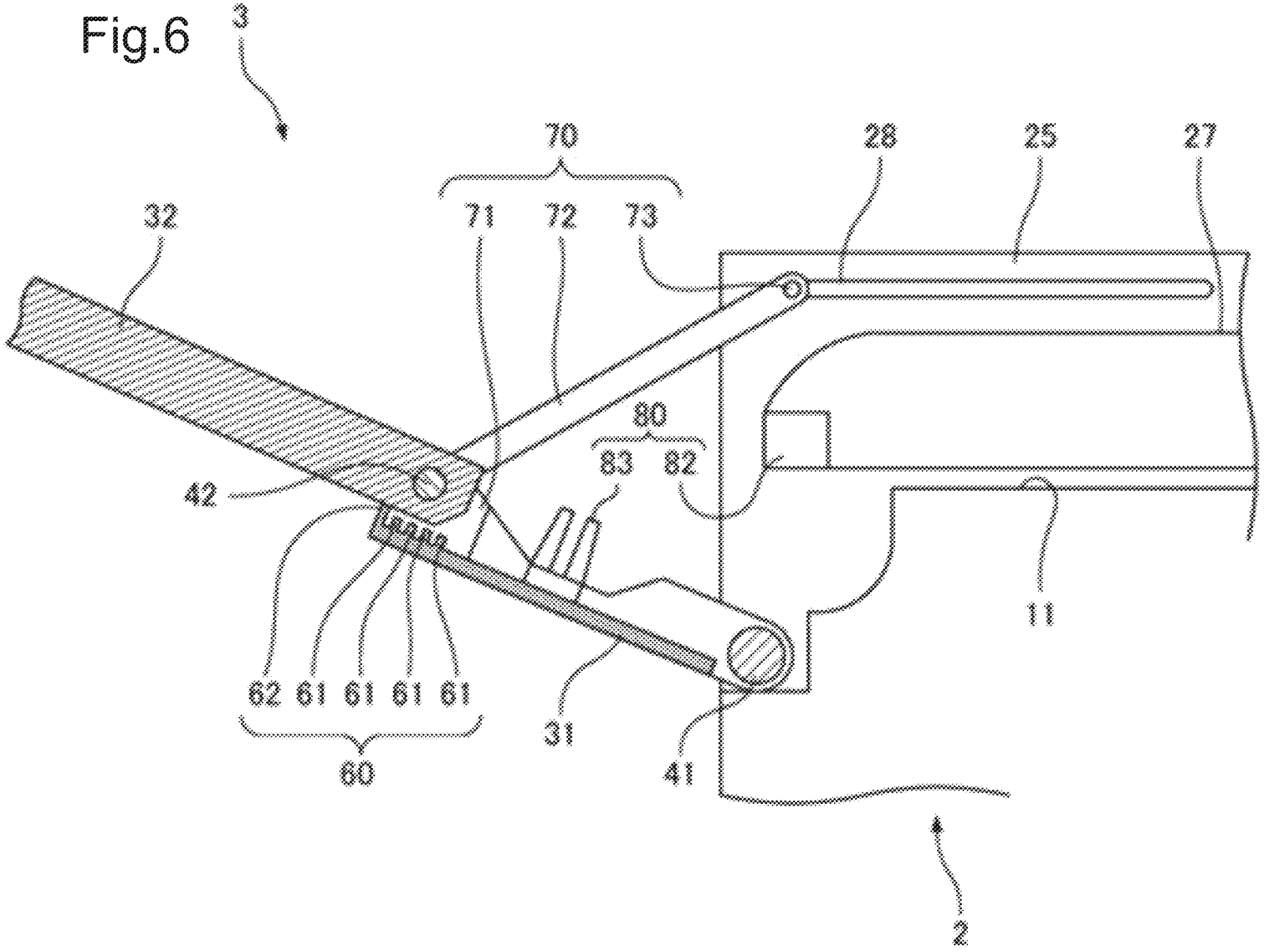
FIG. 6 is a vertical cross-sectional view showing the straight path discharge tray, set to the open state.
Figure 7:
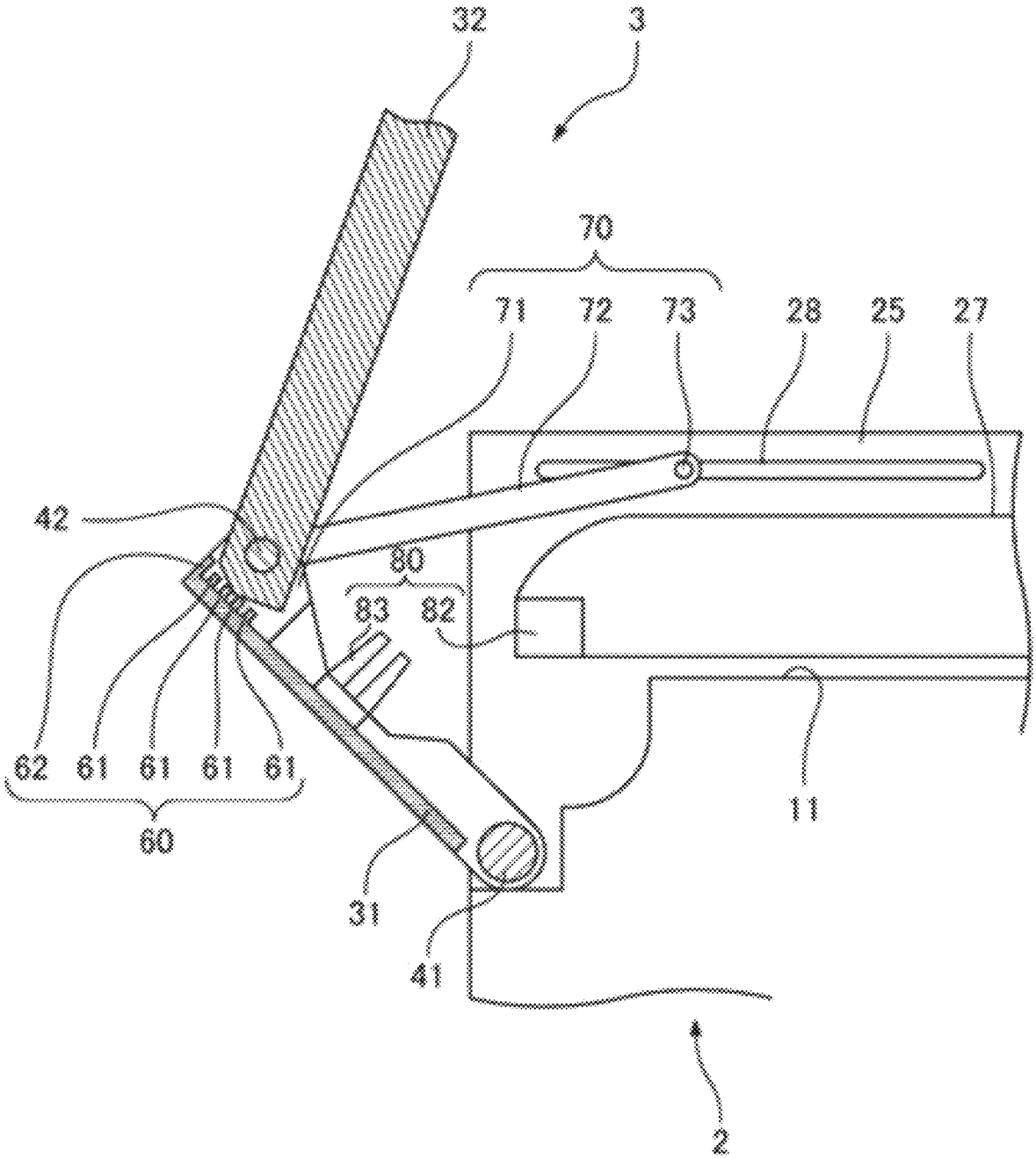
FIG. 7 is a vertical cross-sectional view showing the straight path discharge tray, slightly closed from the open state.
Figure 8:
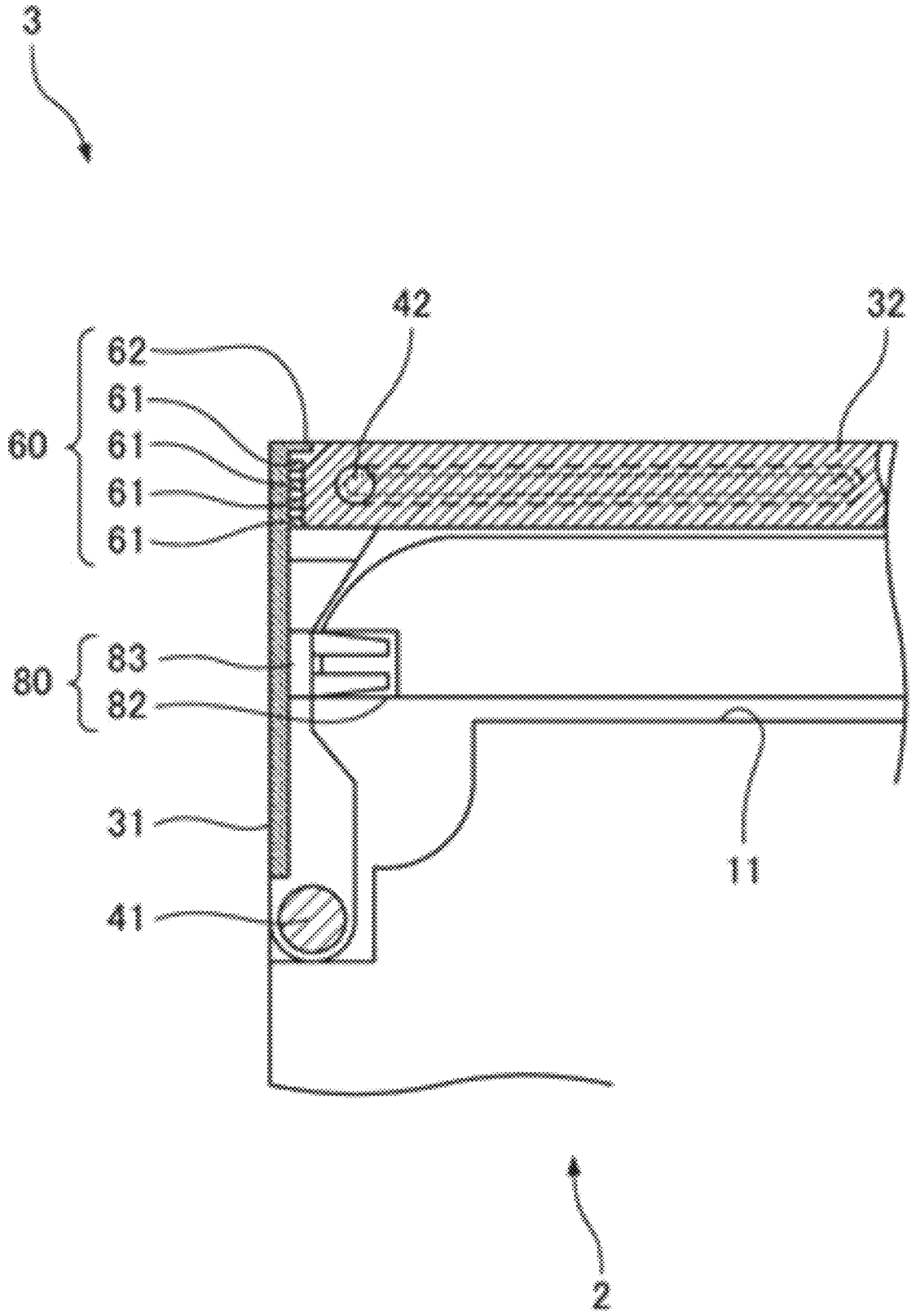
FIG. 8 is a vertical cross-sectional view showing the straight path discharge tray, set to the closed state.

Referring to FIG. 6 to FIG. 8, the movement of the straight path discharge tray 3, performed when shifting from the open state to the closed state, will be described hereunder. FIG. 6 is a vertical cross-sectional view showing the straight path discharge tray 3, set to the open state. FIG. 7 is a vertical cross-sectional view showing the straight path discharge tray 3, slightly closed from the open state. FIG. 8 is a vertical cross-sectional view showing the straight path discharge tray 3, set to the closed state;

As shown in FIG. 6 to FIG. 8, the straight path discharge tray 3 further includes a motion limiting device 60. The motion limiting device 60 serves to delimit the pivotal motion of the second tray section 32, to the posture of the open state in the direction away from the casing 2, and to the posture of the closed state, in the direction toward the casing 2.

Accordingly, the motion limiting device 60 serves to restrict the second tray section 32 from opening further from the open state, and from closing further from the closed state. As result, the straight path discharge tray 3 can be smoothly shifted from the open state to the closed state, and therefore the space saving effect of the transport device 100 can be smoothly attained.

As shown in FIG. 6 to FIG. 8, the straight path discharge tray 3 further includes a first fulcrum 41, a second fulcrum 42, and a stay 70, in addition to the first tray section 31 and the second tray section 32.

The first fulcrum 41 is pivotably connecting the casing 2 and the first tray section 31. The first fulcrum 41 is located such that the first tray section 31 and the side face of the casing 2 on the downstream side becomes flush with each other, in the closed state.

The length of the first tray section 31 in the transport direction in the open state is determined such that, in the closed state, the face of the second tray section 32 oriented upward and the upper face of the casing 2 become flush with each other. The first tray section 31 includes closing limiting ribs 61 and an opening limiting rib 62, formed on the end portion on the downstream side, as part of the motion limiting device 60.

The closing limiting ribs 61 are abutted against the second tray section 32 in the closed state, thereby restricting the second tray section 32 from pivoting further toward the casing 2, from the position of the closed state, and thus retaining the second tray section 32 in the posture of the closed state. In the closed state, for example, the first tray section 31 and the second tray section 32 define an angle of 90°. The closing limiting ribs 61 restrict the angle between the first tray section 31 and the second tray section 32 from becoming narrower than 90°.

The opening limiting rib 62 is abutted against the second tray section 32 in the open state, thereby restricting the second tray section 32 from pivoting further in the direction away from the casing 2, from the position of the open state, and thus retaining the second tray section 32 in the posture of the open state. In the open state, for example, the first tray section 31 and the second tray section 32 define an angle of 180°. The opening limiting rib 62 restricts the angle between the first tray section 31 and the second tray section 32 from becoming wider than 180°.

The second fulcrum 42 is pivotably connecting the first tray section 31 and the second tray section 32. The second fulcrum 42 is located at the position that allows the second tray section 32 to be accommodated inside the storage space 24, in the closed state.

The stay 70 includes a base 71, an arm 72, and a slide member 73. The base 71 is attached to the first tray section 31. The arm 72 has one end portion and the other end portion. The one end portion of the arm 72 is rotatably connected to the base 71. To the other end portion of the arm 72, the slide member 73 is attached. The slide member 73 can slide along a slide groove 28 formed in the casing 2. The first fulcrum 41 is engaged with the base 71.

Figure 9:
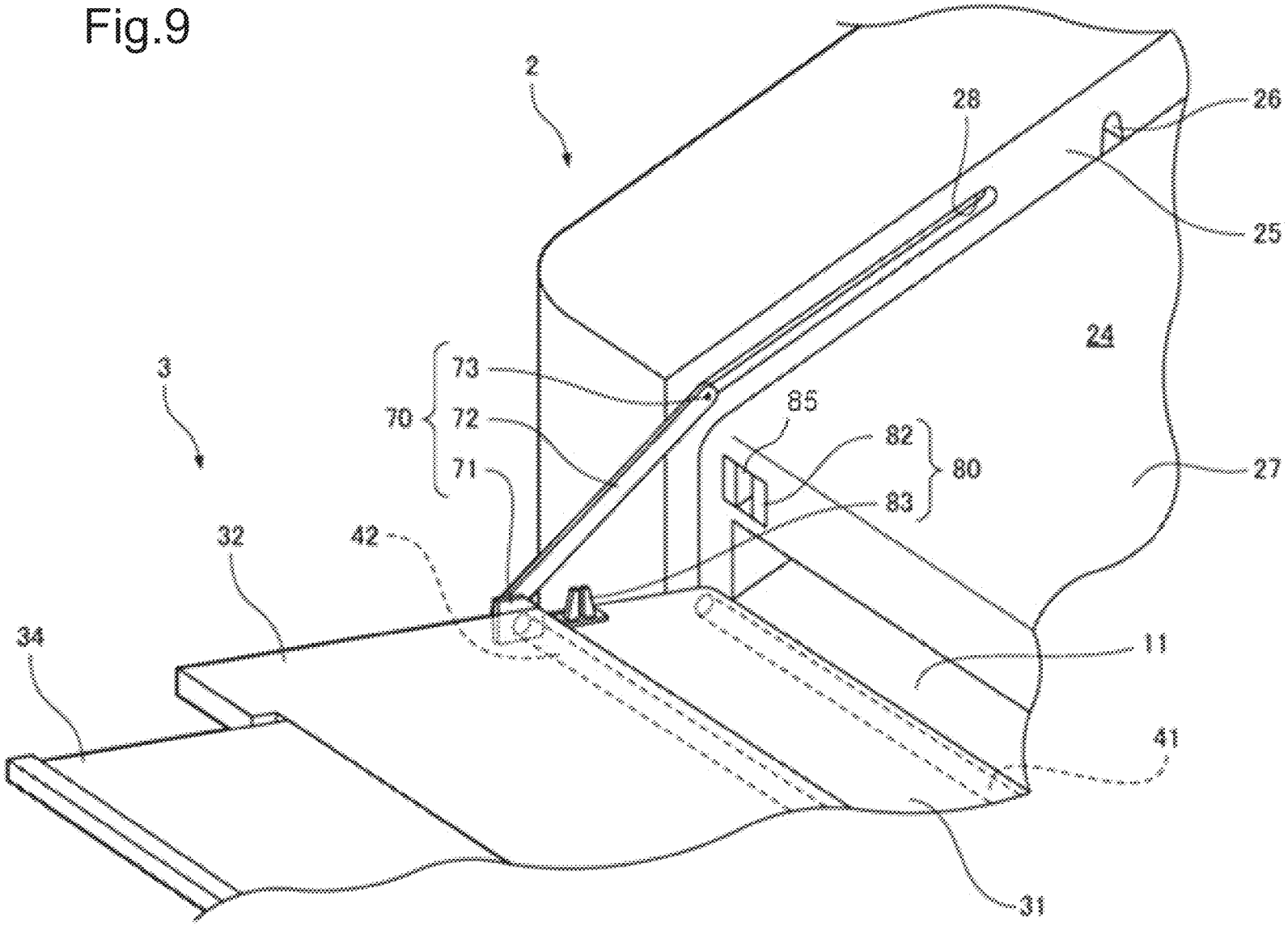
FIG. 9 is a perspective view showing a structure for detecting the closed state of the straight path discharge tray.

Hereunder, the detection of the closed state of the straight path discharge tray 3 will be described hereunder, with reference to FIG. 9. FIG. 9 is a perspective view showing the structure for detecting the closed state of the straight path discharge tray 3.

As shown in FIG. 9, the casing 2 includes the inner side face 25 and an inner upper face 27. The inner side face 25 and the inner upper face 27 define the storage space 24. In the inner side face 25, the engaging hole 26 and the slide groove 28 are formed. The slide groove 28 extends parallel to the transport direction.

The slide groove 28 has one end portion and the other end portion. The one end portion of the slide groove 28 is on the downstream side. The one end portion of the slide groove 28 coincides with the position of the slide member 73, in the open state. The slide member 73 is attached to the slide groove 28, so as to slide thereinside. In the open state, the slide member 73 moves to the one end portion of the slide groove 28, thus to be restricted from sliding further, as shown in FIG. 9. Therefore, the straight path discharge tray 3 is restricted from pivoting further in the direction away from the casing 2, and retained in the posture of the open state. The other end portion of the slide groove 28 is on the upstream side. The other end portion of the slide groove 28 is located upstream of the position of the slide member 73 in the closed state.

The transport device 100 further includes a detection device 80 that detects the closed state. The transport device 100 can detect the closed state of the straight path discharge tray 3, using the detection device 80.

The detection device 80 includes a detection rib 83 and a sensor 82. The detection rib 83 is provided on the first tray section 31, at a position that does not interfere with the sheet S discharged through the straight path. The sensor 82 is located between the inner upper face 27 and the straight transport route 11. To be more specific, the sensor 82 is located inside a cavity 85 formed in the casing 2. The cavity 85 is formed in the casing 2, at the position where the detection rib 83 on the first tray section 31 is inserted, in the closed state. Thus, in the closed state the detection rib 83 is inserted in the cavity 85, and removed therefrom in a state other than the closed state. The sensor 82 is for example an optical sensor, including a light emitter and a photodetector. The light emitter is located on one sidewall of the cavity 85, and the photodetector is located on the other sidewall opposing the one sidewall. When the detection rib 83 is not inserted in the cavity 85, the photodetector receives the light from the light emitter, but when the detection rib 83 is inserted in the cavity 85 and interposed between the photodetector and the light emitter, thereby blocking the light from the light emitter, the photodetector is unable to receive the light from the light emitter. When the photodetector is receiving the light from the light emitter, the detection device 80 outputs an ON signal indicating the open state, to a controller 29 of the transport device 100 to be subsequently described, but outputs an OFF signal indicating the closed state to the controller 29, when the photodetector is not receiving the light from the light emitter. With such an arrangement, the transport device 100 can stably detect the closed state of the straight path discharge tray 3.

Figure 10:
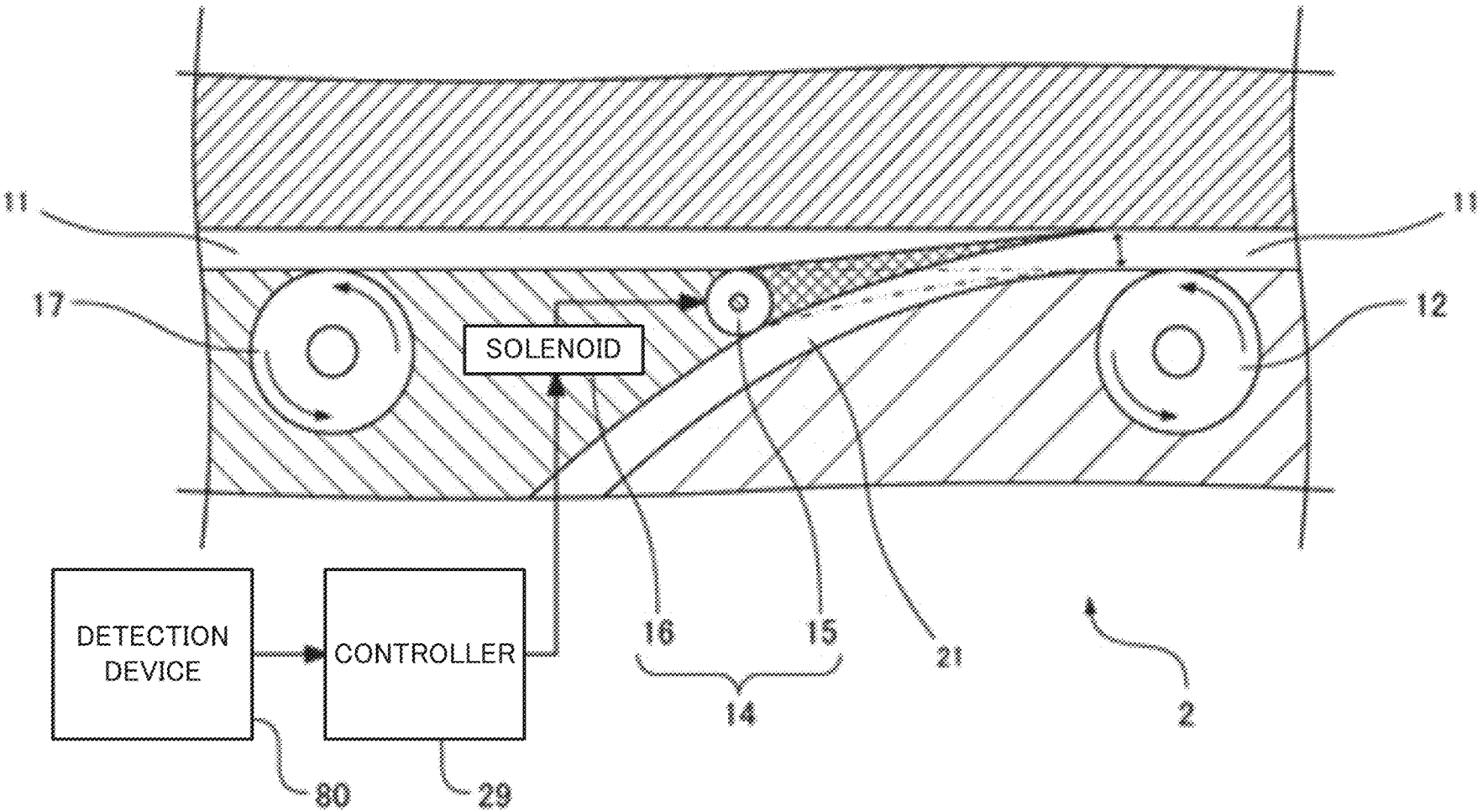
FIG. 10 is an enlarged vertical cross-sectional view for explaining a configuration of a portion in the proximity of a branch guide.

Hereunder, a control performed by the branch guide 14 will be described in detail, with reference to FIG. 10. FIG. 10 is an enlarged vertical cross-sectional view for explaining the configuration of a portion in the proximity of the branch guide 14.

The casing 2 includes the branch guide 14. The branch guide 14 is located at the branch point between the straight transport route 11 and the reversing transport route 21. The branch guide 14 guides the sheet S that has reached the position upstream of the branch point through the straight transport route 11, either to the downstream side through the straight transport route 11, or to the reversing transport route 21.

The casing 2 further includes a controller 29. The controller 29 includes a processor, a random-access memory (RAM), a read-only memory (ROM), and an exclusive hardware circuit. The processor is, for example, a central processing unit (CPU), an application specific integrated circuit (ASIC), or a micro processing unit (MPU). The controller 29 operates according to a control program, for example stored in the ROM.

The controller 29 switches the destination to which the branch guide 14 guides the sheet S, between the straight transport route 11 and the reversing transport route 21. When the detection device 80 is not detecting the closed state, the controller 29 switches the branch guide 14 so as to guide the sheet S to the straight transport route 11.

In other words, when the straight path discharge tray 3 is not in the closed state, the branch guide 14 guides the sheet S so as to proceed only through the straight transport route 11. As result, when the straight path discharge tray 3 is set to discharge the sheet S through the straight path, the casing 2 can also be automatically set to discharge the sheet S, through the straight path.

Hereunder, further detail of the configuration of the branch guide 14 will be described, with reference to FIG. 10.

As shown in FIG. 10, the branch guide 14 includes a pivotal guide plate 15 and a solenoid 16. The pivotal guide plate 15 can be switched, by being made to pivot, between a posture to guide the sheet S to the reversing transport route 21, and a posture to guide the sheet S to the straight transport route 11. The pivotal guide plate 15 blocks the straight transport route 11, when assuming the posture to guide the sheet S to the reversing transport route 21. The pivotal guide plate 15 blocks the reversing transport route 21, when assuming the posture to guide the sheet S to the straight transport route 11. The solenoid 16 is driven by control signals from the controller 29. The driving force generated by the solenoid 16 is converted to rotative driving force via a gear mechanism, and transmitted to the pivotal guide plate 15, so that the pivotal guide plate 15 is made to pivot.

When the pivotal guide plate 15 is set to the posture to guide the sheet S to the reversing transport route 21, the transport device 100 operates in a mode to transport the sheet S from the straight transport route 11 to the reversing transport route 21 (hereinafter, reversing transport mode). When the pivotal guide plate 15 is set to the posture to guide the sheet S to the straight transport route 11, the transport device 100 operates in a mode to transport the sheet S only through the straight transport route 11 (hereinafter, straight path mode).

When the detection device 80 detects the closed state, the controller 29 transmits a control signal for setting the reversing transport mode, to the solenoid 16. With the control signal for setting the reversing transport mode, the solenoid 16 is driven so as to generate the driving force that causes the pivotal guide plate 15 to pivot, in the direction for assuming the posture to guide the sheet S to the reversing transport route 21. By being made to pivot by such driving force, the pivotal guide plate 15 assumes the posture to guide the sheet S to the reversing transport route 21.

When the detection device 80 ceases to detect the closed state, the controller 29 transmits the control signal for setting the straight path mode, to the solenoid 16. With the control signal for setting the straight path mode, the solenoid 16 is driven so as to generate the driving force that causes the pivotal guide plate 15 to pivot, in the direction for assuming the posture to guide the sheet S to the straight transport route 11. By being made to pivot by such driving force, the pivotal guide plate 15 assumes the posture to guide the sheet S to the straight transport route 11.

Existing transport devices include the straight path discharge tray for receiving the sheet discharged through the straight path. In order to receive the discharged sheet, the straight path discharge tray has to have an area larger than the sheet. Therefore, although such transport device is capable of discharging the sheet through the straight path, a physically large space is required to install the transport device.

With the configuration according to the foregoing embodiment, in contrast, while the transport device 100 is configured to discharge the sheet S through the straight path, the transport device 100 can save the installation space, when the sheet S is not scheduled to be discharged.

The embodiment of the disclosure has been described as above, with reference to the drawings. However, the disclosure is not limited to the foregoing embodiment, but may be modified in various manners, without departing from the scope of the disclosure. The drawings each schematically illustrate the elements for the sake of clarity, and the thickness, length, number of pieces, and interval of the illustrated elements may be different from the actual ones, because of the convenience in making up the drawings. Further, the material, shape, and size of the elements referred to in the foregoing embodiment are merely exemplary and not specifically limited, and may be modified as desired, without substantially departing from the configuration according to the disclosure.

INDUSTRIAL APPLICABILITY

The disclosure provides the sheet transport device, and is therefore industrially applicable.

What is claimed is:

1. A transport device comprising:

a supply tray that supplies a sheet;

a casing into which the sheet is supplied from the supply tray; and a straight path discharge tray to which the sheet is discharged from the supply tray and the casing, through a straight path, wherein the casing includes:

a straight transport route through which the sheet is linearly transported;

a reversing transport route through which the sheet is transported so as to be reversed, the reversing transport route being branched from the straight transport route; and an image reading device that reads an image on the sheet being transported through the straight transport route, the straight path discharge tray includes:

a first tray section pivotably attached to the casing; and a second tray section pivotably attached to the first tray section, and the straight path discharge tray is switchable between an open state in which the first tray section and the second tray section form a receiving surface for the sheet, and a closed state in which the first tray section and the second tray section partially cover the casing, wherein the transport device further comprises:

a first fulcrum pivotably connecting the casing and the first tray section; and a second fulcrum pivotably connecting the first tray section and the second tray section, the first tray section comprises:

closing limiting ribs abutted against an end position on a side of the second fulcrum of the second tray section in the closed state to restrict the second tray section from pivoting toward the casing from the position of the closed state; and an opening limiting rib abutted against the second tray section in the open state from below to restrict the second tray section from pivoting in the direction away from the casing from the position of the open state.

2. The transport device according to claim 1, wherein the straight path discharge tray further includes an engagement device to be engaged with the casing, in the closed state.

3. The transport device according to claim 1, further comprising a detection device that detects the closed state.

4. The transport device according to claim 3, wherein the casing includes:

a branch guide provided at a branch point between the straight transport route and the reversing transport route, and configured to guide the sheet to one of the straight transport route and the reversing transport route; and a controller including a processor, and configured to switch, when the processor executes a control program, a destination to which the branch guide guides the sheet, between the straight transport route and the reversing transport route, and the controller switches the branch guide so as to guide the sheet to the straight transport route, when the closed state is not detected by the detection device.

5. The transport device according to claim 4, wherein the controller switches the branch guide so as to guide the sheet to the reversing transport route, when the closed state is detected by the detection device.

6. The transport device according to claim 1, further comprising:

a base attached to the first tray section and engaged with the first fulcrum;

an arm having one end portion which rotatably connected to the base; and a slide member attached to the other end portion of the arm and configured to be slidable along a slide groove formed in the casing, wherein, in the open state, the slide member moves to one end portion of the slide groove to be restricted from further sliding at one end portion of the slide groove.

* * * * *